United States Patent [19]

McMahan

[11] Patent Number: 4,458,762

[45] Date of Patent: Jul. 10, 1984

[54] RECLOSEABLE AUXILIARY VALVE

[75] Inventor: Michael E. McMahan, Duncan, Okla.

[73] Assignee: Halliburton Company, Duncan, Okla.

[21] Appl. No.: 370,519

[22] Filed: Apr. 21, 1982

[51] Int. Cl.[3] ..... E21B 34/12

[52] U.S. Cl. ..... 166/373; 166/334; 251/54

[58] Field of Search ..... 166/331, 332, 334, 373, 166/381, 386, 387; 251/54

[56] References Cited

U.S. PATENT DOCUMENTS

| | | | |
|---|---|---|---|
| Re. 29,562 | 3/1978 | Wray et al. | 166/0.5 |
| 2,874,927 | 2/1959 | Conrad | 166/334 X |
| 3,249,124 | 5/1966 | Berryman | 166/331 |
| 3,329,214 | 7/1967 | Ehlert | 166/331 |
| 3,332,495 | 7/1967 | Young | 166/331 X |
| 4,113,012 | 9/1978 | Evans et al. | 166/264 |
| 4,113,018 | 9/1978 | Barrington et al. | 166/334 |

*Primary Examiner*—Stephen J. Novosad
*Assistant Examiner*—Michael Starinsky
*Attorney, Agent, or Firm*—Lucian Wayne Beavers; James R. Duzan; Thomas R. Weaver

[57] ABSTRACT

A recloseable auxiliary valve includes a cylindrical housing having a central flow passage disposed therethrough. A flapper valve is disposed in the housing and is movable between a closed position wherein the central flow passage is closed and an open position wherein the central flow passage is open. An operating mandrel is provided for operating the flapper valve upon telescoping movement of the mandrel relative to the housing. A releasable locking system is provided for locking the mandrel and the flapper valve in their open position. A time-delay system is provided to prevent premature telescopingly collapsing movement of the mandrel relative to the housing as the auxiliary valve is run into the well.

21 Claims, 8 Drawing Figures

RECLOSEABLE AUXILIARY VALVE

The present invention relates generally to downhole auxiliary valves, and particularly to an auxiliary valve using a flapper valve actuated by a stinger.

An auxiliary valve is a flow control valve which is normally run into a well, with a test string, in a closed position so that well fluids do not enter the test string. The auxiliary valve is subsequently opened after the test string is in place within the well to allow the testing operation to be performed. An auxiliary valve is also often used in well stimulation operations.

A typical prior art auxiliary valve is that which has been used by the assignee of the present invention and which is marketed under the name RTTS Auxiliary Valve. The RTTS Auxiliary Valve is a full opening valve having a housing with a flapper valve disposed in the lower end of the housing, and having a stinger for engaging the flapper valve to open the same. The stinger is moved relative to the housing to open the flapper valve by right-hand rotation of the test string which operates a screw mechanism within the RTTS Auxiliary Valve. This screw mechanism moves the stinger relative to the housing. Once the flapper valve of the RTTS Auxiliary Valve is in its open position, it cannot be reclosed because a ratchet in the RTTS Auxiliary Valve prevents left-hand rotation of the screw mechanism.

The present invention provides a recloseable auxiliary valve which is actuated by setting down weight on the auxiliary valve rather than by rotation. The present invention provides two primary improvements over the RTTS Auxiliary Valve. Rotation of the test string as required with the RTTS Auxiliary Valve is often difficult, particular in offshore operations, and this rotation is eliminated by the present invention which allows operation by merely setting down weight upon the tool. Also, the present invention provides an auxiliary valve which may be reclosed. Furthermore, this closing is accomplished very quickly by merely torquing the test string and picking up weight.

The auxiliary valve of the present invention includes a cylindrical housing having a central flow passage disposed therethrough. A flapper valve is disposed in the housing and is movable between a closed position wherein the central flow passage is closed and an open position wherein the central flow passage is open. An operating mandrel means for operating the flapper valve includes a mandrel telescopingly received in an upper end of the housing. The housing, flapper valve and operating mandrel means are so arranged and constructed that when the operating mandrel means is in a telescopingly extended position relative to the housing, a lower end of the mandrel is located above the flapper valve and the flapper valve is in its closed position. When the operating mandrel means is in a telescopingly collapsed position relative to the housing, the lower end of the mandrel holds the flapper valve in its open position. A releasable locking means is provided for locking the operating mandrel means and the housing in their telescopingly collapsed position to hold the flapper valve in its open position. A time-delay means is provided for retarding telescopingly collapsing movement of the mandrel relative to the housing in order to prevent premature opening of the flapper valve when running the test string into the well.

Numerous objects, features and advantages of the present invention will be readily apparent to those skilled in the art upon a reading of the following disclosure when taken in conjunction with the accompanying drawings.

FIGS. 1A–1F comprise an elevation half-sectioned view of the recloseable auxiliary valve of the present invention.

Figure 1A:
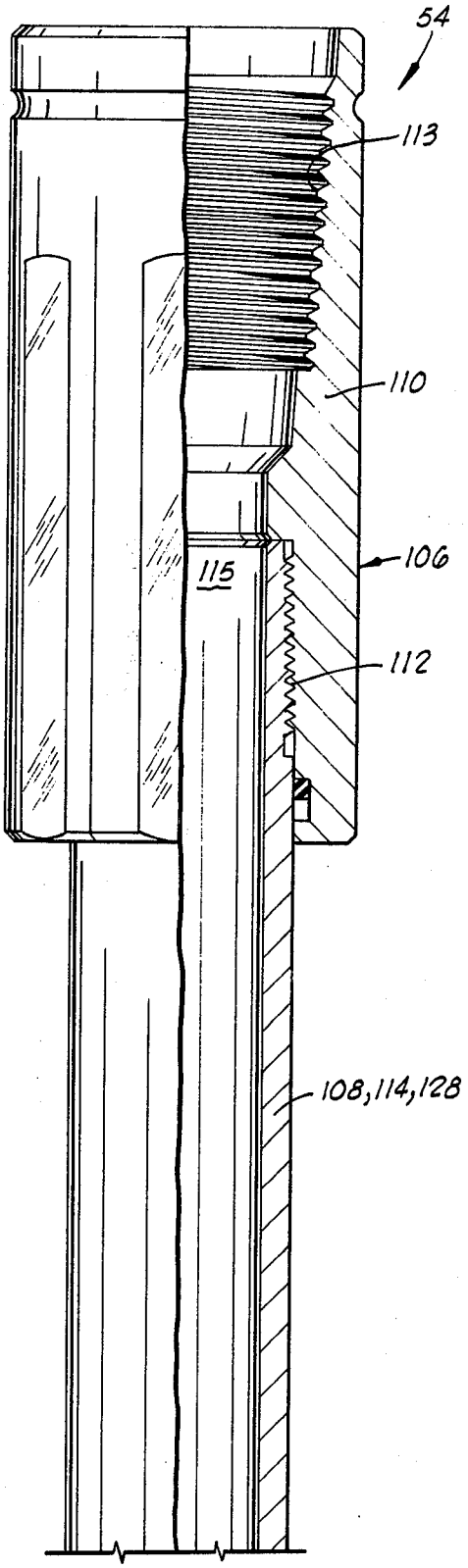
Figure 1B:
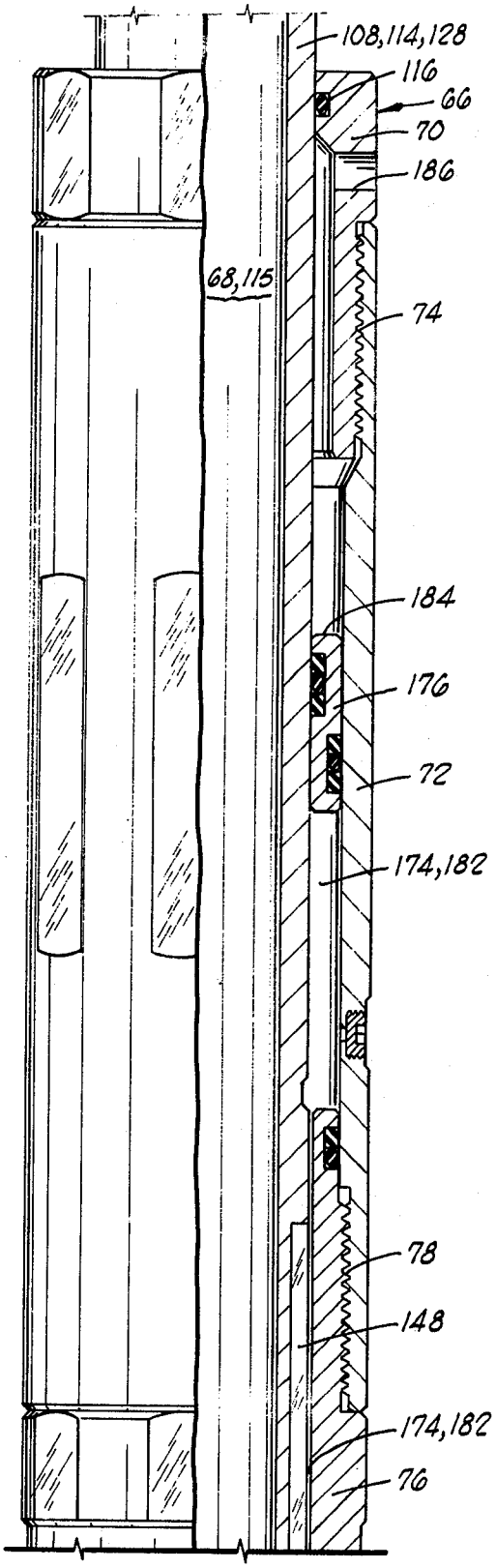

Referring now to the drawings, and particular to FIG. 3, the general environment in which the present invention is utilized will be described.

A floating drilling vessel or work station 10 is positioned over a submerged well site 12. A wellbore 14 has been drilled and lined with a casing string 16 intersecting a subsurface formation 18 to be tested. Formation fluid from the formation 18 may communicate with the interior of a test string 20 through perforations 22 provided in the casing string 16 opposite the formation 18.

A submerged wellhead installation 24 includes blowout preventer mechanisms 26. A marine conductor 28 extends between the wellhead 24 and the work station 10. A deck structure 30 on the work station 10 provides a work platform from which the formation testing string 20, comprising a plurality of generally tubular elements, is lowered by a hoisting means 32 through marine conductor 28, wellhead installation 24, and casing string 16, to the subsurface formation 18. A derrick structure 34 supports the hoisting means 32. A wellhead closure 36 closes off the annular opening between the testing string 20 and the top of the marine conductor 28.

A supply conduit 38 is provided to transmit fluids such as drilling mud to an annulus 40 between the test string 20 and the casing string 16 below the blow-out preventers 26. A pump 42 is provided to impart pressure to the fluid in conduit 38.

An upper test string portion 44 extends from the work station 10 to a subsea test tree 46. An intermediate test string portion 48 extends from the subsea test tree 46 to a torque transmitting slip joint 50. Below slip joint 50 are generally located a number of drill collars represented as 52 for the purpose of imparting weight to the lower portion of the testing string 20.

An auxiliary valve 54 of the present invention is included in the test string 20 above a circulation valve 56.

The test string 20 typically also includes pressure recorders 58 and a formation testing valve 60.

Near the end of the testing string 20 is a packer means 62 for sealing the annulus 40 above the formation 18. Below the packer means 62 is a perforated tail pipe 64 which allows formation fluids to enter the test string 20.

Several drill collars 63 may be located above packer means 62 to allow weight to be set down on packer means 62 without setting down weight on auxiliary valve 54.

Referring now to FIGS. 1A–1F, the auxiliary valve 54 of the present invention is there illustrated in detail.

Auxiliary valve 54, which may generally be referred to as a downhole valve apparatus, includes a cylindrical housing 66 having a central flow passage 68 disposed therethrough.

The central housing 68 includes a retainer cap 70, a floating case 72 threadedly connected to retainer cap 70 at threaded connection 74, an upper nipple 76 threadedly connected to floating case 72 at connection 78, a lug holder case 80 threadedly connected to upper nipple 76 at connection 82, a metering case 84 threadedly connected to lug holder case 80 at connection 86, a slip case 88 threadedly connected to metering case 84 at connection 90, and a bottom adapter 92 threadedly connected to slip case 88 at connection 94.

Slip case 88 has a valve seat insert 96 held in place therein by a set screw 98.

A flapper valve 100 is pivotally attached to slip case 88 by pivot pin 102. A valve spring 104 resiliently biases flapper valve 100 toward rotation in a clockwise direction as viewed in FIG. 1E about pivot pin 102 so that the flapper valve 100 is biased toward its closed position as shown in FIG. 1E with the flapper valve 100 sealingly engaging the valve seat insert 96.

Figure 1C:
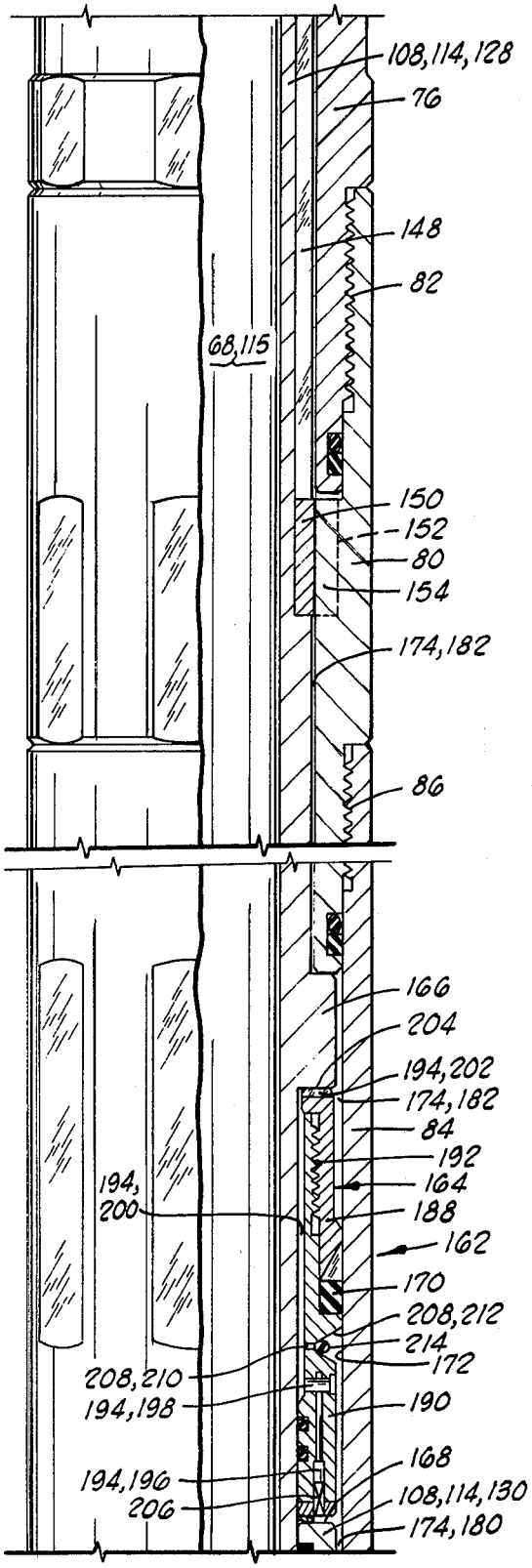
Figure 1D:
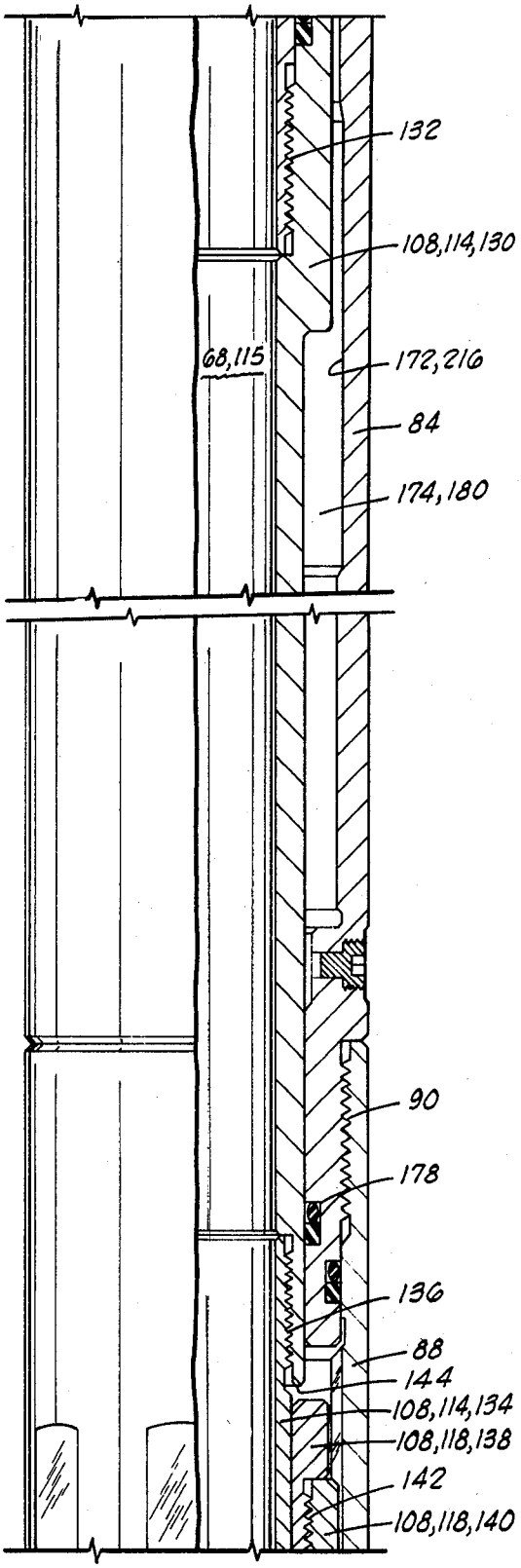
Figure 1E:
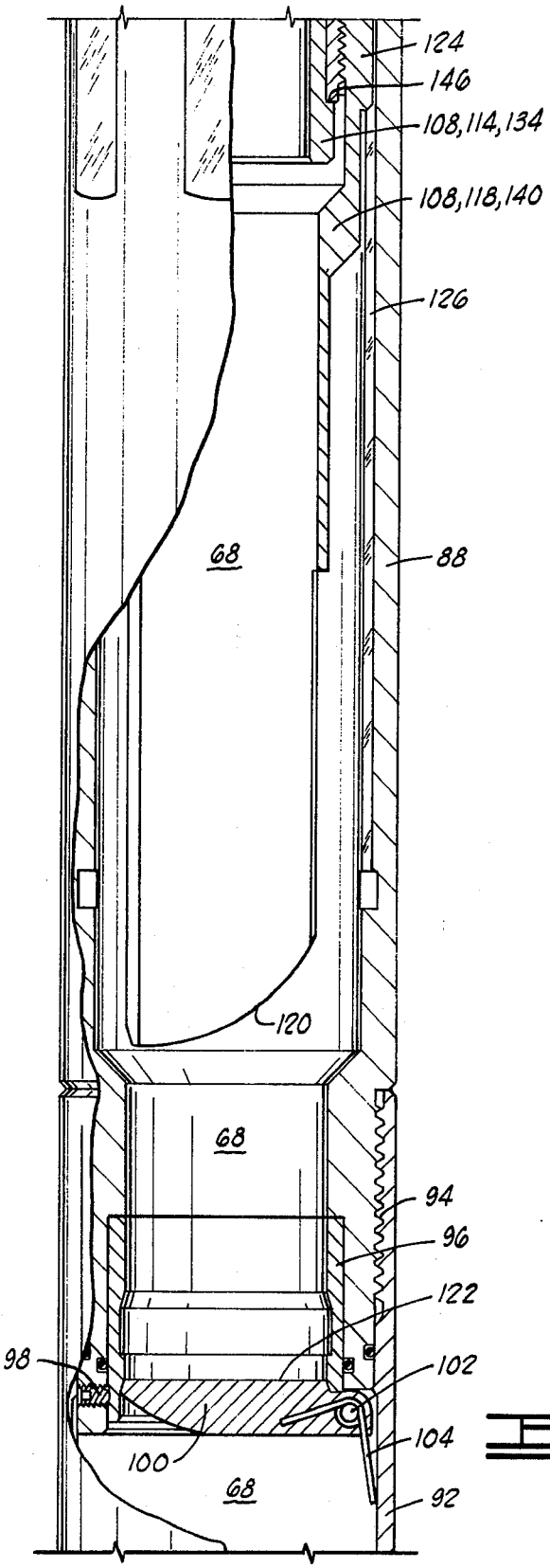
Figure 1F:
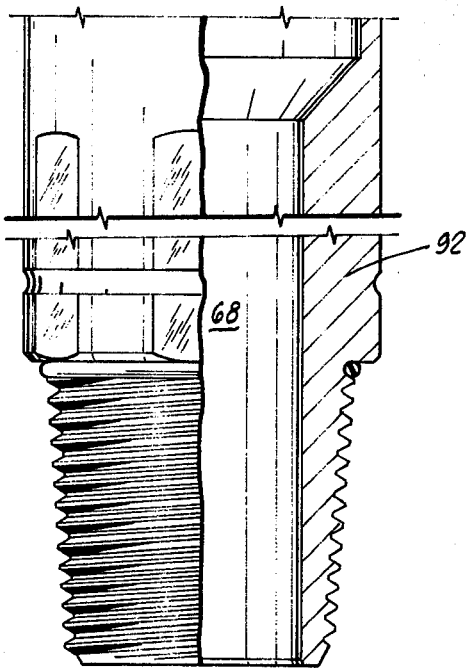

The flapper valve 100 is shown in FIG. 1E in its closed position wherein the central flow passage 68 is closed. As is further described below, the flapper valve 100 is movable to an open position (not shown) wherein the flapper valve 100 is rotated approximately 90° counterclockwise about pivot pin 102 from the position shown in FIG. 1E so that the central flow passage 68 is open.

The auxiliary valve 54 also includes an operating mandrel means 106 for operating the flapper valve 100.

The operating mandrel means 106 includes a mandrel 108 having an upper adapter means 110 threadedly connected thereto at 112. Upper adapter 110 includes an internally threaded portion 113 for connection of the auxiliary valve 54 to other portions of the testing string 20.

Operating mandrel means 106 includes a central bore 115 which is communicated with and partially coincident with the central flow passage 68 of the housing 66.

The mandrel 108 includes an upper mandrel portion 114 which is telescopingly received within housing 66, and a sliding seal between upper mandrel portion 114 and housing 66 is provided by resilient annular seal means 116.

Mandrel 108 further includes a lower mandrel portion 118 seen in FIGS. 1D and 1E.

Lower mandrel portion 118 includes a curved lower end 120 adapted for engagement with an upper side 122 of flapper valve 100 for pushing the flapper valve toward its open position.

Lower mandrel portion 118 includes a radially outward extending longitudinal spline means 124 which engages a radially inward extending longitudinal spline means 126 of slip case 88 of housing 66. The engagement of spline means 124 and 126 allows lower mandrel portion 118 to freely move longitudinally relative to housing 66, but prevents lower mandrel portion 118 from rotating relative to housing 66.

The upper mandrel portion 114 includes a J-slot mandrel 128, a metering mandrel 130 threadedly connected to J-slot mandrel 128 at threaded connection 132, and a slip mandrel 134 threadedly connected to metering mandrel 130 at 136.

The lower mandrel portion 118 includes a slip nut 138 and a stinger 140 which are threadedly connected together at 142.

Slip nut 138 is longitudinally contained between a lower end surface 144 of metering mandrel 130 and an upward facing ledge 146 of slip mandrel 134. Slip nut 138 is loosely received about slip mandrel 134 so that slip nut 138 may rotate relative to slip mandrel 134 thereby allowing relative rotation between upper mandrel portion 114 and lower mandrel portion 118. This is necessary to allow operation of a releasable locking means including a J-slot 148 described below.

The operating mandrel means 106 is shown in FIGS. 1A–1F in its telescopingly extended position relative to the housing 66, wherein the lower end 120 of lower mandrel portion 118 is located above flapper valve 100 so that flapper valve 100 remains in its closed position due to the biasing from spring 104.

To open flapper valve 100 weight is set down upon the auxiliary valve 54 by means of the test string 20 to move the operating mandrel means 106 downward relative to the housing 66 to a telescopingly collapsed position so that the lower end 120 of stinger 140 pushes flapper valve 100 to its open position and the flapper valve 100 is held in its open position by the stinger 140 which extends downward past pivot pin 102 when the auxiliary valve 54 is in its telescopingly collapsed position.

The extent of relative movement allowable between operating mandrel means 106 and housing 66 is defined by an inverted J-slot 148, disposed within an outer surface of J-slot mandrel 128, within which is received a lug means 150 which is splined to lug holder case 80 of housing 66 by splines 152 of lug means 150 and spline 154 of lug holder case 80. Although only one J-slot 148 and one lug means 150 are illustrated, there are actually two of each located 180° apart.

The J-slot 148 and lug means 150 may be collectively referred to as a releasable locking means, operatively associated with housing 66 and mandrel 108, for releasably locking mandrel 108 in its telescopingly collapsed position relative to the housing 66.

Figure 2:
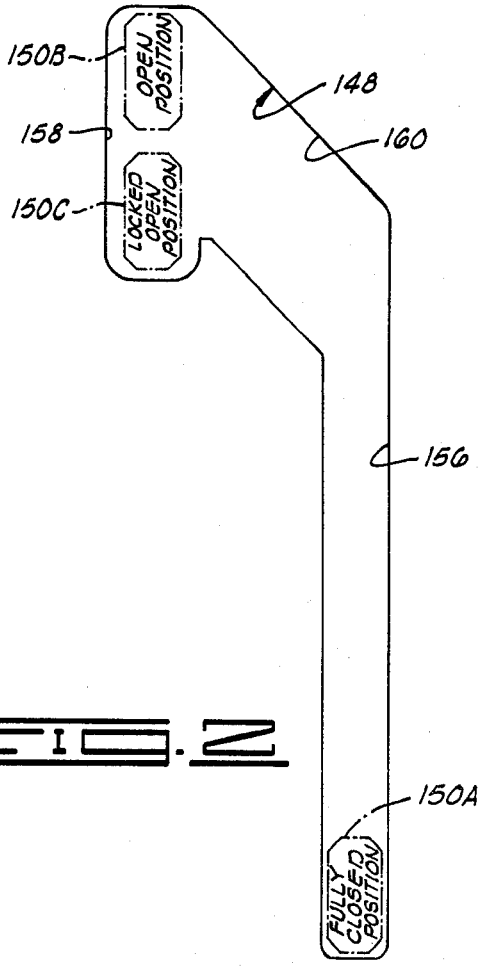
FIG. 2 is a laid-out view of the releasable locking means including a J-slot and a lug.

The J-slot 148 is shown in FIG. 2 in a laid-out position as viewed from the outside of mandrel 108 looking radially inward towards mandrel 108.

J-slot 148 includes a long leg portion 156, a short leg portion 158 and a sloped connecting portion 160 which is sloped downward from an upper end of short leg portion 158 to an upper end of long leg portion 156.

Shown in phantom lines in FIG. 2 are the three operating positions of lug means 150 relative to the J-slot 148.

In the phantom position designated 150A the lug means is illustrated in its fully closed position. This is the position of the lug means 150 relative to the J-slot 148 when the mandrel 108 is in its fully extended position relative to housing 66 as shown in FIGS. 1A–1F. In that position the flapper valve 100 is fully closed and thus is referred to as the fully closed position 150A of the lug means 150.

When the mandrel 108 is telescopingly collapsed relative to housing 66, the J-slot 148 is moved downward relative to lug means 150 and then is rotated slightly when lug means 150 engages the upper side of sloped connecting portion 160 of slot 148 until the J-slot 148 reaches the open position indicated in phantom lines as 150B in FIG. 2.

If weight is picked up from the test string 20 with the lug means 150 in its open position 150B, the J-slot 148 moves up slightly until the lug means 150 reaches its locked open position designated in phantom lines as 150C in FIG. 2 wherein the lug means 150 is trapped in the lower portion of short leg portion 158 of J-slot 148. Thus, in the absence of any torque being applied to test string 20, the lug means 150 will remain locked in the short leg portion 158 of J-slot 148 upon any picking up or setting down of the test string 20, thus locking the flapper valve 100 in its open position.

To unlock the mandrel 108 from the housing 66, right-hand torque is applied to the test string 20 while weight is set down on the auxiliary valve 54. This moves the lug means 150 from the open position 150B through the sloped connecting portion 160 of J-slot 148 into the upper end of long leg portion 156. Then by picking up weight from the auxiliary valve 54 with the test string 20 the mandrel 108 is telescopingly extended relative to the housing 66 so that the lug means 150 moves through the long leg segment 156 of J-slot 148 to the position designated as the fully closed position 150A in FIG. 2.

During the lowering of the testing string 20 into the well casing 16, the test string 20 sometimes encounters tight spots which place a compressional load across the auxiliary valve 54. As mentioned above, the auxiliary valve 54 is in its telescopingly extended position with the flapper valve 100 closed when it is run into the well. To prevent premature opening of the flapper valve 100 when a tight spot is encountered during the lowering process, a time-delay means generally designated by the numeral 162 in FIG. 1C is provided. The time-delay means 162 is operatively associated with the mandrel 108 for retarding telescoping collapsing movement of the mandrel 108 relative to the housing 66.

The time-delay means 162 includes a piston means 164 which is disposed on upper mandrel portion 114 and is held between a shoulder 166 of J-slot mandrel 128 and an upper end 168 of metering mandrel 130.

Piston means 164 includes a sealing element 170 which is slidably and sealingly received within an inner cylindrical surface 172 of metering case 84 of housing 66.

A metering fluid chamber means 174 is defined between mandrel 108 and housing 66 and has an upper end defined by floating annular piston means 176 and has a lower end defined by annular resilient seal 178.

The sealing element 170 of piston means 164 divides metering fluid chamber means 174 into a lower first chamber portion 180 and an upper second chamber portion 182.

An upper side of annular floating piston 176 is communicated with an exterior of housing 66 through a port 186. Thus, a hydraulic metering fluid contained in metering fluid chamber means 174 is maintained at substantially the same pressure as the well fluid in the annulus 40 thereby equalizing fluid pressure across the wall of housing 66 to prevent collapse of the same from external pressure within the annulus 40. Floating piston 176 also allows the metering fluid to expand if it is heated by the downhole environment.

Piston means 164 includes an upper piece 188 and a lower piece 190 threadedly connected together at 192 to hold the sealing element 170 therebetween.

A first passage 194 is disposed through piston means 164 and communicates the first and second chamber portions 180 and 182. First passage 194 includes a longitudinal bore portion 196, a radial bore portion 198, an annular space portion 200 between J-slot mandrel 128 and lower piece 190, and a radially extending space portion 202 passing across the upper end of upper piece 188 between some longitudinally upward extending protrusions 204 of upper piece 188.

A flow impedance means 206 is disposed in longitudinal bore portion 196 of first passage 194 for impeding flow of metering fluid from first chamber portion 180 through first passage 194 to second chamber portion 182, and for thereby providing a time delay in telescopingly collapsing movement of mandrel 108 relative to housing 66.

The flow impedance means 206 is a reduced diameter orifice insert. Preferably a time delay for the telescopingly collapsing movement is provided on the order of about two and one-half to three minutes.

A second passage 208 is disposed through piston means 164 and also communicates the first and second chamber portions 180 and 182. Second passage 208 includes a plurality of radially extending bores such as 210 which communicate annular space 200 with a tapered groove 212 in the outer surface of lower piece 190, which tapered groove 212 is communicated with first chamber portion 180. A resilient O-ring member 214 is disposed in tapered groove 212 and acts as a check valve element which allows metering fluid to flow from second chamber portion 182 through passage portions 202 and 200, then through the bores 210 into the annular groove 212, but prevents reverse flow due to the wedging of O-ring element 214 against the outer ends of radial bores 210.

Thus, the O-ring element 214 which may also be referred to as a check valve means 214 is disposed in the second metering passage 208 for preventing flow of metering fluid from the first chamber portion 180 through said second passage 208 to the second chamber portion 182, and for allowing relatively unimpeded flow of metering fluid from the second chamber portion 182 through the second passage 208 to the first chamber portion 180 upon telescopingly extending movement of the mandrel 108 relative to housing 66.

The inner cylindrical surface 172 of metering case 84 of housing 66 includes an enlarged diameter portion 216. The dimensions of the various elements are such that upon telescopingly collapsing movement of mandrel 108 relative to housing 66, the lower end 120 of lower mandrel portion 118 engages the upper side 122 of flapper valve 100 and begins opening flapper valve 100 so that formation fluid pressure from the formation 118 has a chance to equalize across flapper valve 100 before sealing element 170 of piston means 164 reaches the enlarged diameter portion 216 of inner cylindrical surface 172. This equalization of pressure across flapper valve 100 prior to attempting to rapidly push flapper valve 100 to a fully open position is important to prevent damage to flapper valve 100.

Once the sealing element 170 does pass into the enlarged diameter portion 216, metering fluid is allowed to bypass the first passage 178 of piston means 164 thus flowing directly around piston means 164 through the annular clearance between piston means 164 and the enlarged diameter portion 216 so that further telescopingly collapsing movement of mandrel 108 relative to housing 66 is no longer impeded by the time-delay means 162.

The method of the present invention of communicating the subsurface formation 18 with an interior of the test string or pipe string 20 generally includes the following steps.

First, the recloseable auxiliary valve 54 is attached to a lower portion of the test string 20. Also attached to a lower portion of the test string 20 below the auxiliary valve 54 is the packer means 62.

Then the test string 20 with the auxiliary valve 54 and the packer means 62 attached thereto is lowered into the well casing 16 with the auxiliary valve 54 being in a telescopingly extended position as illustrated in FIGS. 1A-1F.

Figure 3:
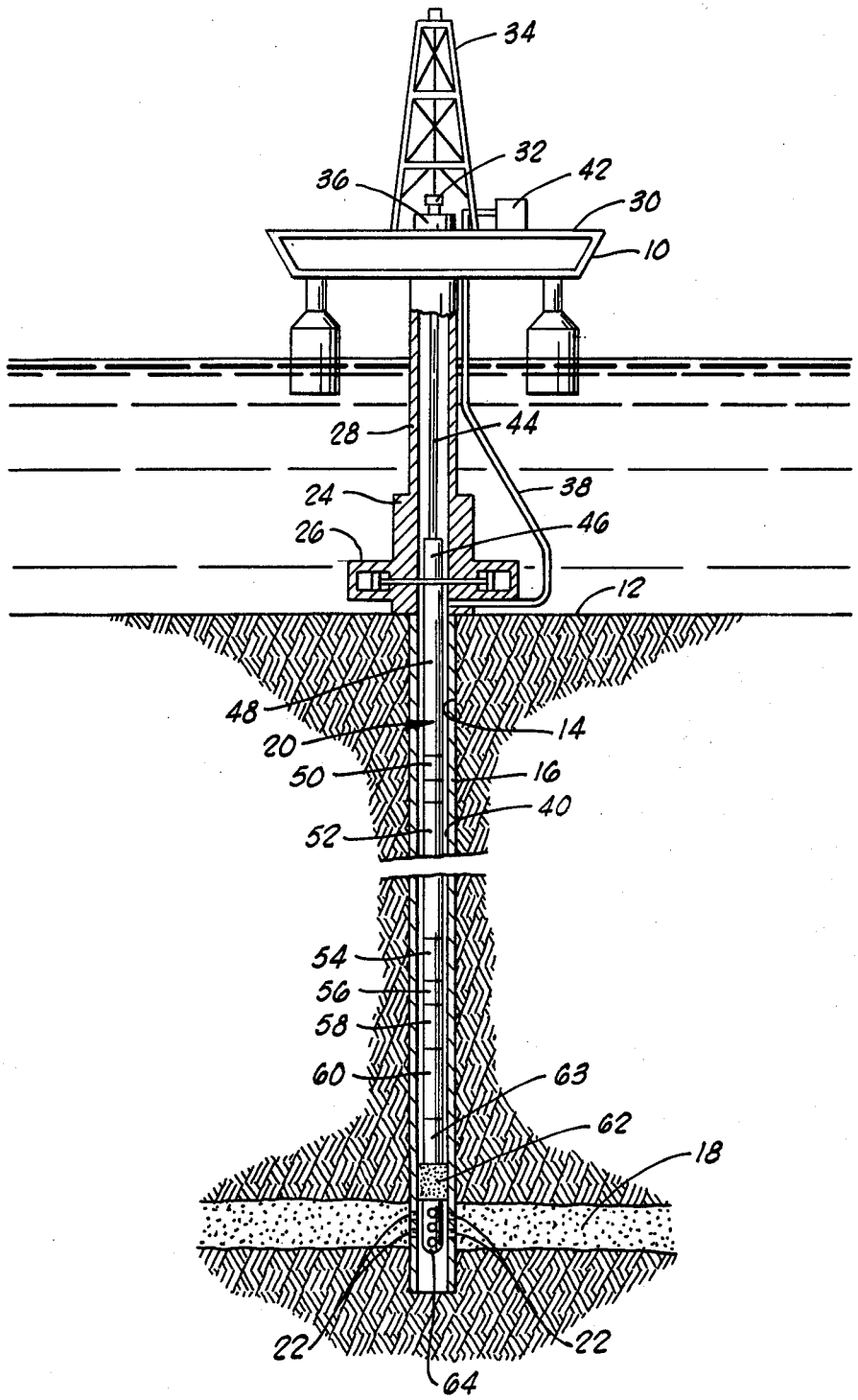
FIG. 3 is a schematic elevation view of a representative offshore installation which may be employed for formation testing purposes and illustrates a formation testing string or tool assembly in position in a submerged wellbore and extending upwardly to a floating operating and testing station.

The test string 20 is lowered until the packer means 62 is positioned above the subsurface formation 18 approximately as illustrated in FIG. 3.

Then weight is set upon the packer means 62 with the test string 20 and the annulus 40 between the test string 20 and the casing string 16 is sealed at a point above the subsurface formation 18. The subsurface formation 18 is communicated through the perforated tail pipe 64 and through the lower end of housing 66 with the lower side of flapper valve 100.

By setting weight on the auxiliary valve 54 telescopingly collapsing movement of the operating mandrel means 106 relative to the housing 66 is initiated.

This telescopingly collapsing movement is initially retarded by the flow impedance means 206 which retards the flow of metering fluid through the first passage 194 of piston means 164.

The telescopingly collapsing movement continues and the lower end 120 of lower mandrel portion 118 engages flapper valve 100 and partially opens flapper valve 100 thereby allowing formation pressure from the formation 18 to equalize across the flapper valve 100.

Subsequently, and still during the telescopingly collapsing movement, the sealing element 170 of piston means 164 moves into the enlarged diameter portion 216 of inner cylindrical surface 172 and thereby bypasses hydraulic metering fluid past the piston means 164 so that telescopingly collapsing movement is no longer retarded.

The telescopingly collapsing movement is then quickly completed thereby inserting the lower mandrel portion 118 completely through the valve seat insert 96 and holding the flapper valve 100 in a fully open position.

The releasable locking means defined by the J-slot 148 and the lug means 150 locks the mandrel 108 in its fully open position.

To unlock the mandrel 108 and reclose the flapper valve 100, right-hand torque is applied to the test string 20 and then weight is picked up from the auxiliary valve 54 thus telescopingly extending the mandrel 108 relative to the housing 66 and reclosing flapper valve 100.

Thus it is seen that the apparatus and methods of the present invention readily achieve the ends and advantages mentioned as well as those inherent therein. Although certain preferred embodiments of the present invention have been illustrated for the purposes of the present disclosure, numerous changes in the arrangement and construction of parts and steps may be made by those skilled in the art which changes are encompassed within the scope and spirit of the present invention as defined by the appended claims.

What is claimed is:

1. A downhole valve apparatus, comprising:

a cylindrical housing having a central flow passage disposed therethrough;

a flapper valve disposed in said housing and movable between a closed position wherein said central flow passage is closed and an open position wherein said central flow passage is open;

an operating mandrel means for operating said flapper valve, said operating mandrel means including a mandrel telescopingly received in an upper end of said housing; and time-delay means, operatively associated with said operating mandrel means, for retarding telescopingly collapsing movement of said mandrel relative to said housing, said time-delay means comprising:

piston means disposed on said mandrel and slidably received within an inner cylindrical surface of said housing;

a metering fluid chamber means defined between said mandrel and said housing, for containing a metering fluid therein, said metering fluid chamber means being partially defined by said inner cylindrical surface of said housing so that said piston means divides said metering fluid chamber means into a first chamber portion and a second chamber portion;

a first passage disposed through said piston means and communicating said first and second chamber portions; and a flow impedance means, disposed in said first passage, for impeding flow of metering fluid from said first chamber portion through said first passage to said second chamber portion and for thereby providing a time delay in telescopingly collapsing movement of said mandrel relative to said housing wherein said housing, flapper valve, and operating mandrel means are so arranged and constructed that when said operating mandrel means is in a telescopingly extended position relative to said housing, a lower end of said mandrel is located above said flapper valve and said flapper valve is in its said closed position, and when said operating mandrel means is in a telescopingly collapsed position relative to said housing, said lower end of said mandrel holds said flapper valve in its said open position.

2. The apparatus of claim 1, further comprising:

releasable locking means, operably associated with said housing and said mandrel, for releasably locking said mandrel in its said telescopingly collapsed position relative to said housing.

3. The apparatus of claim 2, wherein said releasable locking means comprises:

lug means, connected to one of said mandrel and said housing; and

J-slot means, disposed in the other of said mandrel and said housing, and having said lug means slidably received therein.

4. The apparatus of claim 3, wherein:

said lug means is connected to said housing and extends radially inward therefrom; and said J-slot means is disposed in a radially outer surface of said mandrel.

5. The apparatus of claim 4, wherein:

said J-slot means and said lug means are so arranged and constructed that upon applying torque in a predetermined direction to said downhole valve apparatus and picking up weight from said downhole valve apparatus, said mandrel is telescopingly extended relative to said housing to allow said flapper valve to return to its said closed position.

6. The apparatus of claim 2, wherein:

said mandrel includes an upper mandrel portion and a lower mandrel portion;

said lower mandrel portion includes a radially outward extending longitudinal spline means engaging a radially inward extending longitudinal spline means of said housing, so that said lower mandrel portion is free to move longitudinally relative to said housing and is prevented from rotating relative to said housing;

said upper mandrel portion is connected to said lower mandrel portion in such a manner that said upper mandrel portion may rotate relative to said lower mandrel portion and so that said upper and lower mandrel portions move together longitudinally relative to said housing; and said releasable locking means is operably associated with said upper mandrel portion.

7. The apparatus of claim 1, wherein said time-delay means further comprises:

a second passage disposed through said piston means and communicating said first and second chamber portions; and a check valve means, disposed in said second passage, for preventing flow of metering fluid from said first chamber portion through said second passage to said second chamber portion, and for allowing relatively unimpeded flow of metering fluid from said second chamber portion through said second passage to said first chamber portion upon telescopingly extending movement of said mandrel relative to said housing.

8. The apparatus of claim 7, wherein:

said inner cylindrical surface of said housing includes an enlarged diameter portion so arranged and constructed that, upon telescopingly collapsing movement of said mandrel relative to said housing, a sealing means of said piston means enters said enlarged diameter portion and thereby allows metering fluid to bypass said first passage of said piston means after said lower end of said mandrel has engaged said flapper valve and has begun to move said flapper valve toward its said open position.

9. The apparatus of claim 7 further comprising:

floating annular piston means, disposed between and sealingly engaging said mandrel and said housing, one side of said floating annular piston means being in fluid communication with an exterior of said housing and a second side of said floating annular piston means being in fluid communication with said metering fluid of said metering fluid chamber means, for equalizing fluid pressure across a wall of said housing.

10. A downhole valve apparatus, comprising:

a cylindrical housing having a central flow passage disposed therethrough;

a flapper valve disposed in said housing and movable between a closed position wherein said central flow passage is closed and an open position wherein said central flow passage is open;

an operating mandrel means for moving said flapper valve from its said closed position to its said open position, said operating mandrel means having a first end slidably received in said housing and having a second end extending from said housing, said operating mandrel means having a central bore communicated with said central flow passage of said housing, and said first end of said operating mandrel means being arranged and constructed for engagement with said flapper valve to move said flapper valve from its said closed position to its said open position upon telescopingly collapsing movement of said operating mandrel means relative to said housing;

piston means, disposed on said operating mandrel means and slidably received within an inner cylindrical surface of said housing;

a metering fluid chamber means defined between said operating mandrel means and said housing, for containing a metering fluid therein, said metering fluid chamber means being partially defined by said inner cylindrical surface of said housing so that said piston means divides said metering fluid chamber means into a first chamber portion and a second chamber portion;

a first passage disposed through said piston means and communicating said first and second chamber portions;

a flow impedance means, disposed in said first passage, for impeding flow of metering fluid from said first chamber portion through said first passage to said second chamber portion and for thereby providing a time delay in telescopingly collapsing movement of said operating mandrel means relative to said housing;

a second passage disposed through said piston means and communicating said first and second chamber portions;

a check valve means, disposed in said second passage, for preventing flow of metering fluid from said first chamber portion through said second passage to said second chamber portion, and for allowing relatively unimpeded flow of metering fluid from said second chamber portion through said second passage to said first chamber portion upon telescopingly extending movement of said operating mandrel means relative to said housing;

lug means, connected to one of said operating mandrel means and said housing; and J-slot means, disposed in the other of said operating mandrel means and said housing and having said lug means slidably received therein, for releasably locking said operating mandrel means in a telescopingly collapsed position relative to said housing so that said flapper valve is held in its said open position when weight is picked up from said downhole valve apparatus.

11. The apparatus of claim 10, wherein:

said inner cylindrical surface of said housing includes an enlarged diameter portion so arranged and constructed that, upon telescopingly collapsing movement of said operating mandrel means relative to said housing, a sealing means of said piston means enters said enlarged diameter portion and thereby allows metering fluid to bypass said first passage of said piston means after said first end of said operating mandrel means has engaged said flapper valve and has begun to move said flapper valve toward its said open position.

12. The apparatus of claim 10, wherein:

said J-slot means and said lug means are so arranged and constructed that upon applying torque in a predetermined direction to said downhole valve apparatus and picking up weight from said downhole valve apparatus, said operating mandrel means is telescopingly extended relative to said housing to allow said flapper valve to return to its said closed position.

13. A method of communicating a subsurface formation intersected by a well with an interior of a pipe string, said method comprising the steps of:

(a) attaching, to a lower portion of said pipe string, an auxiliary valve apparatus having a housing, a flapper valve disposed in said housing, an operating mandrel means telescopingly received in said housing for opening said flapper valve upon telescopingly collapsing movement of said operating mandrel means relative to said housing, and time-delay means for retarding telescopingly collapsing motion of said operating mandrel means relative to said housing;

(b) attaching, to a lower portion of said pipe string below said auxiliary valve apparatus, a packer means for sealing an annulus between said pipe string and an inner wall of said well;

(c) lowering said pipe string with said auxiliary valve apparatus and said packer means attached thereto into said well, said auxiliary valve apparatus having said operating mandrel means in a telescopingly extended position relative to said housing so that said flapper valve is closed during said lowering;

(d) positioning said packer means above said subsurface formation;

(e) setting weight on said packer means with said pipe string and thereby setting said packer means and sealing said annulus above said subsurface formation, said subsurface formation being communicated through a lower end of said housing with a lower side of said flapper valve;

(f) setting weight on said auxiliary valve apparatus, and thereby initiating telescopingly collapsing movement of said operating mandrel means relative to said housing;

(g) retarding said telescopingly collapsing movement by impeding flow of a hydraulic metering fluid through a passage disposed in a piston attached to said operating mandrel means, said piston sealingly engaging an inner cylindrical surface of said housing;

(h) engaging a lower end of said operating mandrel means with said flapper valve and partially opening said flapper valve, during said telescopingly collapsing movement, thereby equalizing pressure from said formation across said flapper valve;

(i) after said step (h), and still during said telescopingly collapsing movement, moving a sealing means of said piston into an enlarged diameter portion of said inner cylindrical surface of said housing, and thereby bypassing said hydraulic metering fluid past said piston so that said telescopingly collapsing movement is no longer retarded; and (j) completing said telescopingly collapsing movement of said operating mandrel means relative to said housing and thereby moving said flapper valve to a fully open position.

14. The method of claim 13, further comprising the step of:

releasably locking said operating mandrel means and said housing in their telescopingly collapsed position with said flapper valve in its fully open position.

15. The method of claim 14, wherein:

said step of releasably locking includes the steps of sliding a lug means attached to said housing into an upper short leg portion of an inverted J-shape slot disposed in said operating mandrel means.

16. The method of claim 15, further comprising the steps of:

after said operating mandrel means and said housing are releasably locked in their telescopingly collapsed position, torquing said pipe string and picking up weight from said auxiliary valve apparatus, thereby moving said lug means into a long leg portion of said inverted J-shape slot and unlocking said operating mandrel means and telescopingly extending said operating mandrel means relative to said housing and reclosing said flapper valve.

17. A valve apparatus for use in a testing string in a well bore, the well bore containing fluids therein, the valve apparatus comprising:

a cylindrical housing having a central flow passage disposed therethrough;

a flapper valve disposed in said housing and movable between a closed position wherein said central flow passage is closed and an open position wherein said central flow passage is open;

an operating mandrel means for moving said flapper valve from its said closed position to its said open position, said operating mandrel means having a first end slidably received in said housing and having a second end extending from said housing, said operating mandrel means having a central bore communicated with said central flow passage of said housing, and said first end of said operating mandrel means being arranged and constructed for engagement with said flapper valve to move said flapper valve from its said closed position to its said open position upon telescopingly collapsing movement of said operating mandrel means relative to said housing;

piston means, disposed on said operating mandrel means and slidably received within an inner cylindrical surface of said housing;

a metering fluid chamber means defined between said operating mandrel means and said housing, sealed to prevent the flow of fluids from the well bore thereinto, and containing a metering fluid therein, said metering fluid chamber means being partially defined by said inner cylindrical surface of said housing so that said piston means divides said metering fluid chamber means into a first chamber portion and a second chamber portion;

a first passage disposed through said piston means and communicating said first and second chamber portions; and a flow impedance means, disposed in said first passage, for impeding flow of metering fluid from said first chamber portion through said first passage to said second chamber portion thereby providing a time delay in telescopingly collapsing movement of said operating mandrel means relative to said housing.

18. The valve apparatus of claim 17 wherein said piston includes a second passage disposed therethrough providing communication means between said first and second chamber portions; and a check valve means, disposed in said second passage, for preventing flow of metering fluid from said first chamber portion through said second passage to said second chamber portion, and for allowing relatively unimpeded flow of metering fluid from said second chamber portion through said second passage to said first chamber portion upon telescopingly extending movement of said operating mandrel means relative to said housing.

19. The valve apparatus of claim 18 wherein the valve apparatus further comprises:

lug means, connected to one of said operating mandrel means and said housing; and J-slot means, disposed in the other of said operating mandrel means and said housing and having said lug means slidably received therein, for releasably locking said operating mandrel means in a telescopingly collapsed position relative to said housing so that said flapper valve is held in its said open position when weight is picked up from said downhole valve apparatus.

20. The apparatus of claim 19, wherein:

said inner cylindrical surface of said housing includes an enlarged diameter portion so arranged and constructed that, upon telescopingly collapsing movement of said operating mandrel means relative to said housing, a sealing means of said piston means enters said enlarged diameter portion and thereby allows metering fluid to bypass said first passage of said piston means after said first end of said operating mandrel means has engaged said flapper valve and has begun to move said flapper valve toward its said open position.

21. The apparatus of claim 20, wherein:

said J-slot means and said lug means are so arranged and constructed that upon applying torque in a predetermined direction to said downhole valve apparatus and picking up weight from said downhole valve apparatus, said operating mandrel means is telescopingly extended relative to said housing to allow said flapper valve to return to its said closed position.

* * * * *